United States Patent [19]

McRoskey

[11] 4,441,395

[45] Apr. 10, 1984

[54] TUBE PUNCHING METHOD

[75] Inventor: Jack W. McRoskey, Los Angeles, Calif.

[73] Assignee: Republic Tool & Manufacturing Corporation, Carlsbad, Calif.

[21] Appl. No.: 278,788

[22] Filed: Jun. 29, 1981

[51] Int. Cl.[3] ..... B26F 1/02

[52] U.S. Cl. ..... 83/862; 83/19; 83/54; 83/55; 83/176

[58] Field of Search ..... 83/861-865, 83/19-21, 50, 54, 55, 176; 29/557; 408/1

[56] References Cited

U.S. PATENT DOCUMENTS 1,389,645 9/1921 Hudson ..... 83/55 X 1,997,843 4/1935 Warrell ..... 83/169 X

*Primary Examiner*—James M. Meister

*Attorney, Agent, or Firm*—Whann & McManigal

[57] ABSTRACT

A method of cutting a hole in the wall of a pliable tube in which the tube is flattened and is held with the walls touching each other and in which a plug is cut in one of the sidewalls while the tube is in this flattened position.

4 Claims, 9 Drawing Figures

TUBE PUNCHING METHOD

INTRODUCTION

My invention relates to a method of punching holes in plastic tubes. Certain devices such as, for example, flower or vegetable dusting containers require flexible tubes with openings in the sides of the tubes, which are placed in a container, the dusting powder being forced through the openings and through the tubes by squeezing the container. This produces an imbalance in pressure which forces air and dusting material through a nozzle of the container and onto the flower or vegetable in the form of a dust.

It is an object of my invention to provide a method of punching holes in a plastic or pliable tube by cutting a plug in one side of the tube and in which the opposite side or sidewall of the tube acts as a pliable backup wall which receives the cutting edge of the punch, assuring a full, complete and clean cut in the one sidewall of the tube and assuring that the cutting edge will not engage any hard or metal surfaces which might dull or injure the same.

It is a further object of my invention to provide a method of cutting a hole in the sidewall of the plastic tube in which the tube is first flattened and held in flattened position and in which the punch is forced through one sidewall to cut a plug in that sidewall and thus form an opening and in which the cutting edge of the punch is moved into the surface of the opposite sidewall of the tube, the opposite sidewall forming a pliable backup pad which prevents the cutting edge from being damaged.

In my method, cuttings are performed in such a way as to assure that the cutting edge will move completely through the near wall of the tube and assure that the cut is complete and that it is a clean cut. This is assured if the cutting edge is moved far enough so that there is at least a slight penetration of the side of the tube which forms the backup pad.

It is a still further object of my invention to provide a method for cutting openings in the sidewall of a tube in which, on completion of each cutting operation in which a hole is cut in the tube, the backup pad is continually replaced upon the cutting of another opening, this being accomplished by using the back wall of the tube as the backup pad, which assures that a new backup area will be provided with each punching operation.

It is a further object of my invention to provide a method of cutting openings in a sidewall of a tube in which the tube is flattened against a base plate to form the tube into a front wall and a back wall, the surfaces in contact with each other and in which the back wall of the tube becomes a backup pad which may be penetrated by the cutting edge of the cutting tool, the backup pad protecting the cutting edge from coming into contact with the base plate.

DETAILED DESCRIPTION OF PREFERRED METHOD AND PREFERRED FORM OF APPARATUS FOR PREFORMING THE METHOD

Referring to the drawings, FIG. 1 discloses a tube punching machine, including a tube supply, punches, feed rollers and cut off.

FIGS. 2*a* to 2*e* are fragmentary views illustrating the various steps in the method and diagrammatically showing apparatus whereby the steps of the method are performed.

Figure 1:
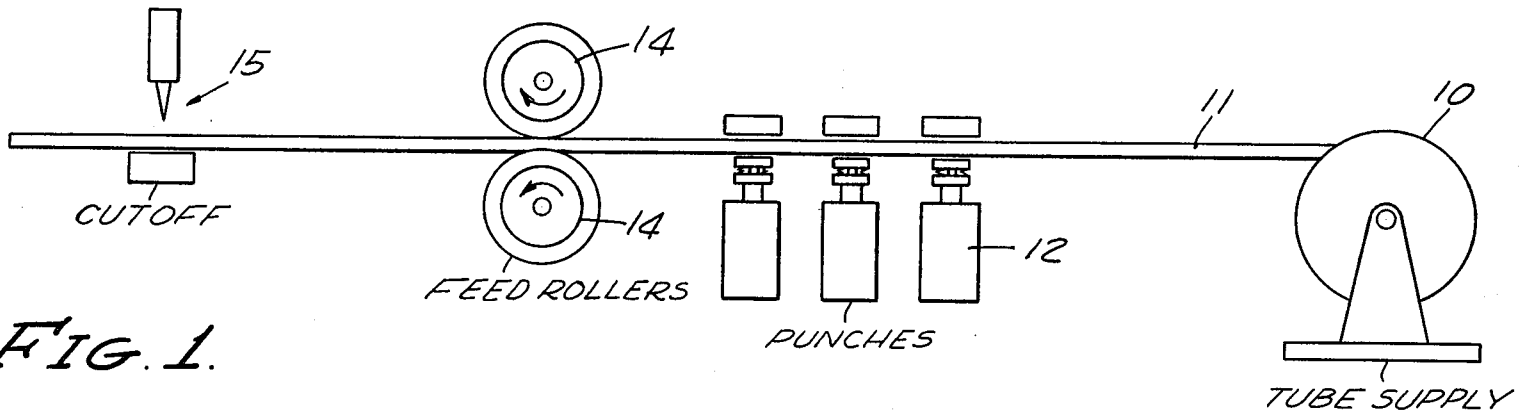

Referring to FIG. 1, there is diagrammatically disclosed a large reel which constitutes a tube supply 10. The tube which is to be punched is designated by the numeral 11 and is moved toward and through the series of punches 12, the tube 11 being fed by means of feed rollers 14. The tube 11 is cut in proper lengths by means of the cut off device 15.

The punches perform identical functions and therefor may be of identical construction and operation. It should be understood, of course, that other forms of the apparatus and even manual operations may be substituted for the punch apparatus which I have shown as a preferred way of performing the method of my invention.

The tube punching apparatus includes a base plate 20 having flat surface 21. The tube 11 is shown in contact with this surface 21 and it should be understood that the feed rollers intermittently feed the tube across the flat surface bringing successive portions of the tube 11 in a position to have an opening punched in it.

Figure 4:
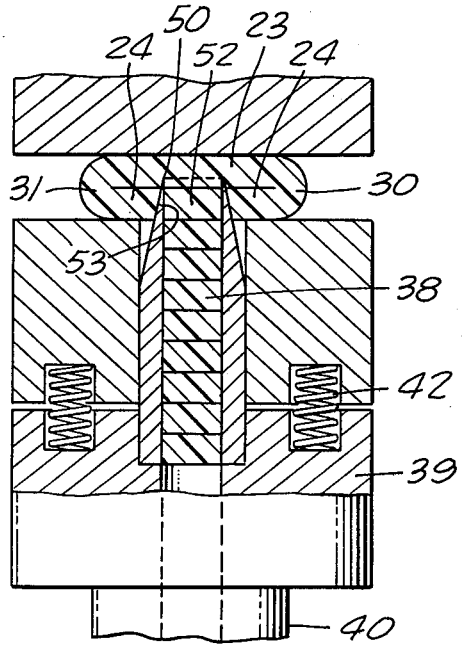
FIG. 4 is an enlarged fragmentary view showing the positions of the parts of the apparatus when the punch has been driven through one wall of the tube and a plug cut therefrom.

The first step in the process is to flatten the tube and this is done in the apparatus by flattening the tube against the surface 21. The tube, when flattened, has the wall of the tube divided into two sides or two walls 23 and 24 and, when flattened, has contacting surfaces 25 and 26. Looking at the flattened wall from a cross sectional angle, as shown in FIG. 4, the two parts or walls 23 and 24 are connected together by bends 30 and 31. The step of flattening the tube is performed by a tube compressor or flattener element 33 which is forced upwardly against the tube. However, the operation of this particular step will be described shortly after a foundation is laid with respect to the punch and how it functions.

The punch 35 is in the form of a cylinder or annulus and has a cutting edge 36 formed by beveling the wall as indicated at 37. The punch 35 is hollow as shown and receives a stripper, the function of which will be described at the appropriate time. The punch 35 is mounted on a plate 39 which plate is in turn mounted on a shaft or similar support 40 which extends into apparatus 44, which is not shown in detail but merely diagrammatically indicated as being within the housing 44. This actuator mechanism includes a means for moving the punch 35 and its associated parts toward and away from the tube. Any sort of reciprocating mechanism could be used and, of course, this operation could be manually performed although it is much more efficient to have the power mechanism for performing this and other functions in the performance of the method.

Getting back now to the compressor or tube flattener 33, this element surrounds the punch 35 and is axially movable with respect thereto. Between the plate 39 and the tube flattener 33 are springs 42 which normally hold the parts 39 and 33, spaced from each other as shown clearly in FIG. 3. The parts as spaced in FIG. 3 (and also in FIGS. 2*a*, 2*b* and 2*e*) is the position of the parts when they are at rest or when the tube flattener 33 has engaged and flattened the tube 11 but at which time the punch has not moved into the wall 24 of the tube.

Figure 3:
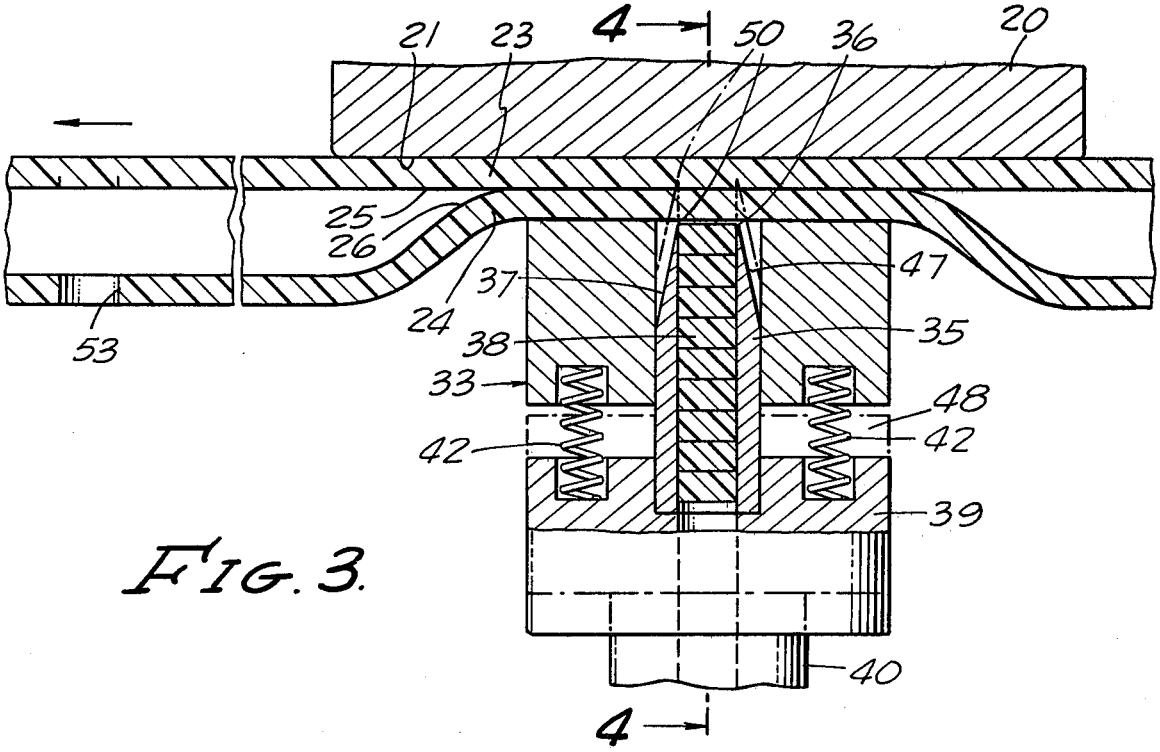
FIG. 3 is an enlarged fragmentary view showing the positions of the parts of the punch apparatus and the position of the tube when the tube is about to be punched.

Now let us assume that the first step of the method has been performed, and the tube has been flattened and the parts of the apparatus and the parts of tube are in the position as shown in FIG. 3. FIG. 3, of course, illustrates only one of the punches 12. One or more openings can be formed in the tube at this time depending upon the requirements of the tube when in use in a piece of apparatus.

The pressure of the part 33 against the tube is sufficient to hold it firmly in the position shown.

At this time the pressure applied for the flattening of the tube holds the tube against the surface 21 of the base plate 20, the front wall 24 constitutes the wall to be perforated and the back wall 23 constitutes a pliable or flexible backup pad for the cutting operation.

The cutting operation is performed which constitutes the step in the method of cutting the opening in the wall 24 of the tube, performed as follows.

The punch 35, as shown in FIG. 3, is moved upward into a dotted position 47 and the plate 39 has moved upward into the dotted position 48. This movement is permitted because the force of the springs 42 is overcome and they become compressed.

At this time the parts are now in the position shown in FIG. 4. The cutting edge of the punch has moved entirely through the lower wall 24 and the cutting edge 50 of the punch has penetrated the surface 25 and may enter the upper wall 23 a slight distance. However, it is only necessary that the cutting edge move beyond the surface 26 so that a complete clean cut is made.

The second wall 23 of the tube as stated becomes a backup pad for the punch device and since it is a plastic material as distinguished from a hard metal surface, the cutting edge is not damaged and will last a relatively long time before need for resharpening.

At this time the punch has cut a plug 52 which leaves an opening 53 in the tube. Also at this time the top end of the stripper 38 is in engagement with the lower surface of the plug.

The opening 53 having been formed in the lower wall of the tube, the next step is to withdraw the plug cutter and this, of course, is done by moving the shaft 40 downward.

However, at this time the stripper need not move but remains in place and holds the plug 53 in its hole, the plug remaining in the tube to be removed at a later time.

When the operation of withdrawing the punch is performed, the first thing that happens is the downward movement of the punch 35. However, the tube flattener does not at this time move but the springs are allowed to expand and when the springs have expanded, then the entire punching device is lowered.

Figure 2A:
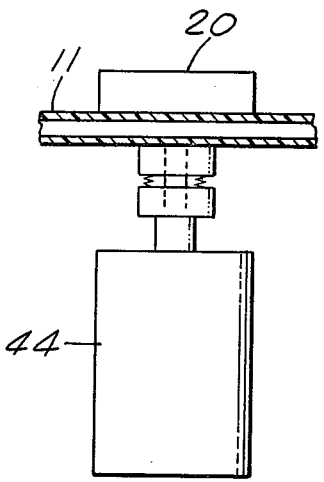
Figure 2B:
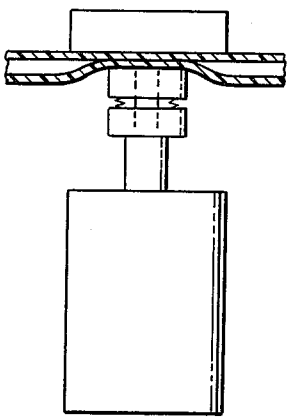
Figure 2C:
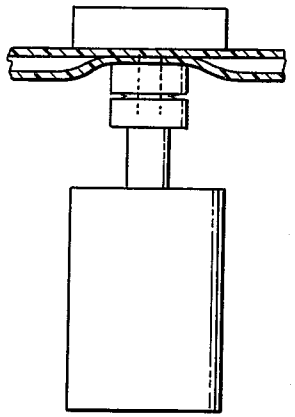

The sequence of the steps of the method is illustrated in FIGS. 2*a* to 2*e* and are briefly explained as follows. In FIG. 2*a* the tube has been moved into position for perforating and movement is stopped and the first step in the method is ready to be performed. The first step is the flattening of the tube and this is done by the upward movement of the shaft 40 which brings the tube flattener 33 into contact with the tube and further upward movement flattens the tube so that it is in the position shown in FIG. 2*b*. With the tube flattened, there is a further upward movement of the shaft 40 and this performs the step of forming the opening in the tube. It will be seen that in FIG. 2*c* the springs 42 have been compressed to allow the punch 33 to move upward, the cutting edge moving through the lower wall portion of the tube 24 and performing a cut as a result of the parts being in the position as shown in FIG. 4.

Figure 2D:
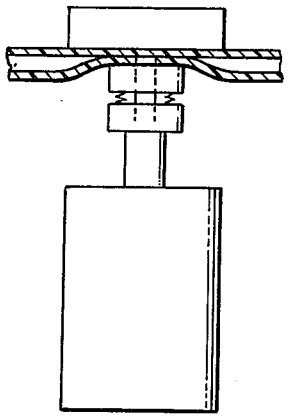

Having made the cut the parts are then moved into the position shown in FIG. 2*d*. The tube flattener remains in place and the other parts move downward, the springs expanding as previously described.

Figure 2E:
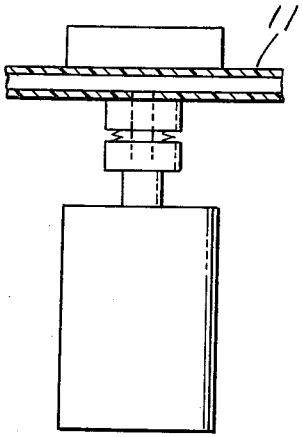

The next step in the process is to move all the parts into the position shown in FIG. 2*e* in which the tube has been allowed to expand into its normal cylindrical shape and the parts are now in a position in which the tube is released and can be moved so that a further sequence of operations can be performed.

An important feature of the method is that the upper or second wall of the tube forms the backup pad for receiving the cutting edge when the cutting operation is performed. The cutting edge, as previously described, moves into the soft material of the backup wall or pad and does not strike any hard surface which might damage or dull the cutting edge.

Since the tube moves after each hole is cut, the backup pad of the tube becomes a constantly renewing backup pad for the cutting device or punch 35.

Figure 5:
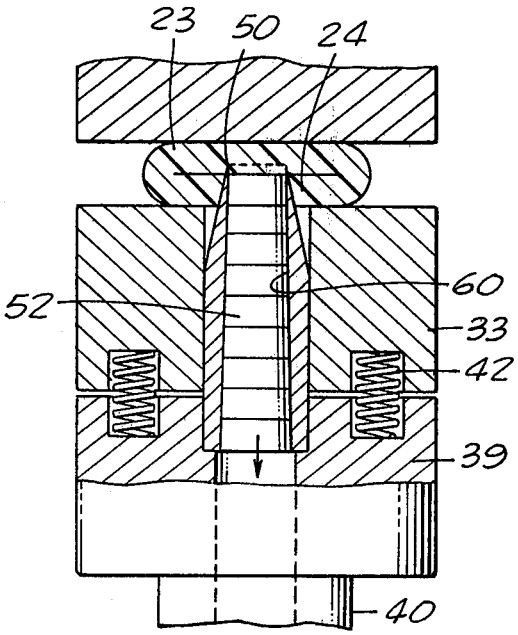
FIG. 5 is a fragmentary view of apparatus of an alternative form wherein the plugs which are punched from the tube are at that time removed from the tube.

If desired, the plug which is cut from the tube may be removed at the time the cutting tool or punch is withdrawn from the flattened tube. This step in the process can be performed by the apparatus shown in FIG. 5 in which all of the parts are the same except that the stripper 38 is removed and the inner wall 60 of the tubular punch is tapered so that the plugs 52 may move downwardly.

The apparatus may be simplified by eliminating the tube flattener 33. With this modified apparatus, flattening of the tube would be accomplished by the punch 35. The tube would be flattened by the sharpened end of the punch engaging the near wall of the tube and pushing it against the opposite wall. When the two sidewalls are in engagement, the punch will then move relative to the near wall, passing through it and forming the cut which produces the removable plug.

I claim:

1. A method of cutting a hole in the wall of a flexible or pliable tube of the steps of:

a. flattening said tube to form first and second sidewalls positioned adjacent to each other and having their surfaces in contact with each other, b. cutting a plug in the first sidewall of said flat tube to form a hole therein by moving a plug cutting tool having a sharp cutting edge completely through said first wall and moving said plug cutting tool so that the cutting edge thereof will enter the surface of the second wall which acts as a backup pad for said first wall, and c. removing said plug cutting tool.

2. A method as defined in claim 1 in which after cutting a hole in said tube according to the method in claim 1, the additional steps of moving the tube to a next position and again performing the method of cutting the hole in the wall of the tube, whereby the second wall of the tube forms a constantly renewed back-up wall for the cutting operations performed on the tube.

3. The method as defined in claim 1 in which said plug is held in place in the hole while the cutting tool is removed from the tube.

4. A method of cutting holes in the wall of a flexible or pliable tube whereby each hole cutting operation is provided with a new backup pad, the steps of:

a. flattening said tube to form first and second sidewalls positioned adjacent to each other and havint their surfaces in contact with each other, b. cutting a plug in the first sidewall of said flat tube to form a hole therein by moving a plug cutting tool having a sharp cutting edge completely through said first wall and moving said plug cutting tool so that the cutting edge thereof will enter the surface of the second wall which acts as a backup pad for said first wall, and c. removing said plug cutting tool.

* * * * *